US005591387A

United States Patent [19]

Takeuchi et al.

[11] Patent Number: 5,591,387

[45] Date of Patent: Jan. 7, 1997

[54] METHOD OF DEMOLDING A GREEN BODY AND FINISHING SAME

[75] Inventors: Hideo Takeuchi; Kazuo Senda, both of Aichi, Japan

[73] Assignee: Inax Corporation, Tokoname, Japan

[21] Appl. No.: 288,204

[22] Filed: Aug. 9, 1994

[30] Foreign Application Priority Data

Aug. 23, 1993 [JP] Japan ..... 5-230836

[51] Int. Cl.[6] ..... B28B 1/26; B28B 11/00

[52] U.S. Cl. ..... 264/86; 264/232; 264/571; 425/404; 425/445

[58] Field of Search ..... 425/404, 445; 264/86, 87, 67, 101, 232, 297.1, 334, 571

[56] References Cited

U.S. PATENT DOCUMENTS

| | | | |
|---|---|---|---|
| 2,282,636 | 5/1942 | Bennett | 25/1 |
| 2,867,885 | 1/1959 | Abberley et al. | 25/24 |
| 3,166,202 | 1/1965 | Arnold | 214/1 |

FOREIGN PATENT DOCUMENTS

| | | |
|---|---|---|
| 2261108 | 9/1975 | France . |
| 2008715 | 11/1971 | Germany . |
| 2107018 | 8/1972 | Germany . |
| 965893 | 8/1964 | United Kingdom . |
| 2053886 | 2/1981 | United Kingdom . |

OTHER PUBLICATIONS

Principles of Ceramic Processing, Second Edition, James R. Reed Published by John Wiley & Sons (1995).

Database WPI, Week 9144, Derwent Publications Ltd., London, GB; Sep. 1989 Application No. 91-320121.

*Primary Examiner*—Christopher A. Fiorilla
*Attorney, Agent, or Firm*—Kanesaka & Takeuchi

[57] ABSTRACT

A green body of a vessel-shaped piece of sanitary ware made by slip casting, such as a washbasin, is demolded by a robot having an arm provided at its free end with a suction pad which is brought into contact with the outer surface of the bottom of the green body to hold it by suction. The green body is, then, rotated or otherwise moved for finishing by a stationary device, while it is held by the robot. The robot enables the automatic demolding and finishing of the green body.

5 Claims, 8 Drawing Sheets

Fig.8A *Prior Art*
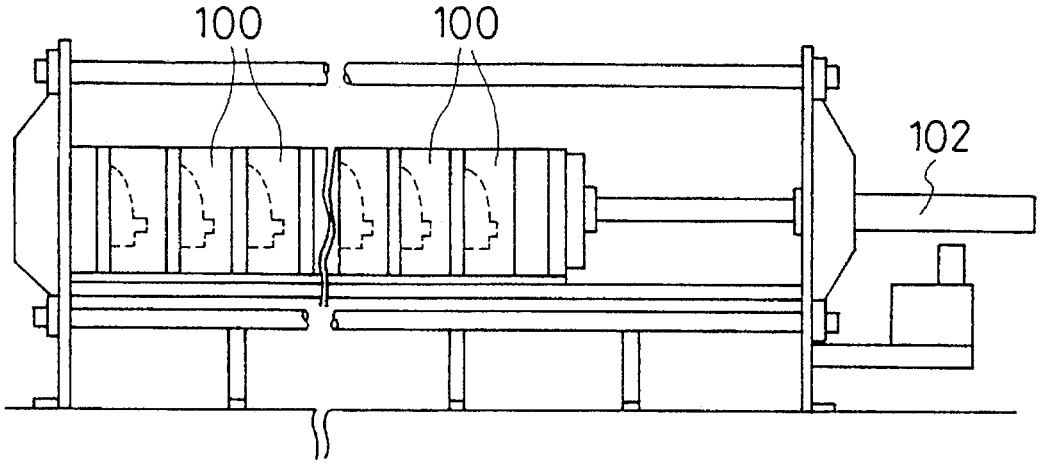
Fig.8B *Prior Art*
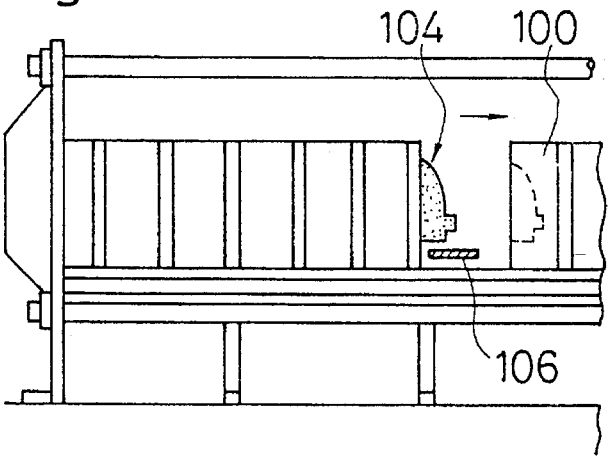
Fig.8C
*Prior Art*
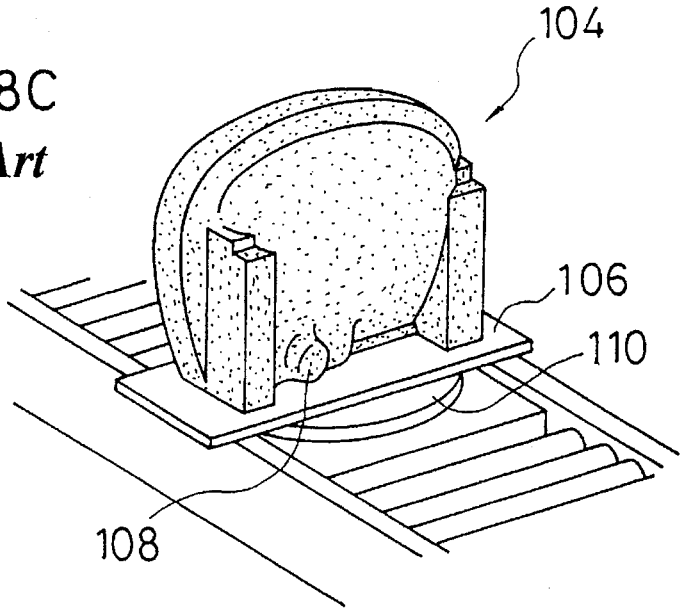

METHOD OF DEMOLDING A GREEN BODY AND FINISHING SAME

BACKGROUND OF THE INVENTION

1. Field of the Invention

This invention relates to a method of demolding and finishing a green body of a vessel-shaped piece of sanitary ware, such as a washbasin.

2. Description of the Prior Art

Slip casting is a method which is widely employed for molding a vessel-shaped piece of sanitary ware, such as a washbasin. A shortened molding cycle is achieved by casting a slip under pressure into a porous mold and drawing water out of the slip into the pores of the mold.

There is known a process which employs a molding apparatus as shown in FIGS. 8A to 8C to eliminate the labor and equipment for closing and opening each mold. This method employs a multiplicity of vertically disposed molds 100 which are horizontally movably juxtaposed, and a single pressure cylinder 102 for closing and pressurizing all of the molds 100 together, so that a slip may be cast into the cavity of each mold.

The slip can be cast simultaneously into all of the molds 100. The work after casting, including the demolding of each green body 104 and its finishing, such as deburring and boring, is, however, done manually by a worker. After each mold 100 has been opened, the green body 104 is manually demolded, and placed on an appropriately positioned pallet 106. Then, the pallet 106 is delivered onto a rotary table 110 and the green body 104 is deburred and bored (108) by hand tools, while the table 110 is manually rotated.

The green body 104 as molded is soft and liable to damage, and calls for the utmost care in its handling. Its finishing involves its complicated movement. Therefore, the demolding and finishing of the green body 104 has been difficult to accomplish mechanically or automatically and has had to be manually done. The manual demolding and finishing of the green body, however, take labor and time, and are an obstacle to an automatic process for manufacturing a green body of sanitary ware.

OBJECT AND SUMMARY OF THE INVENTION

Under these circumstances, it is an object of this invention to provide a Method which enables the automatic demolding and finishing of a green body of a sanitary ware.

This object is attained by a method of demolding and finishing a green body of a sanitary ware obtained by slip casting, in which the green body is demolded by a robot having a sucking action, and is rotated and otherwise moved for finishing by a stationary device, while it is held by the robot.

The method of this invention employs a robot having a sucking action for demolding a green body. The robot preferably has an arm provided at its free end with a suction pad which is brought into contact with the outer surface of the bottom of the green body and holds it by suction. If the suction pad has a sufficiently large area of contact with the green body, it can hold the green body without forming any damage to it, and the robot, therefore, enables the automatic demolding of the green body.

The demolded green body is rotated and otherwise moved for finishing by a stationary device, while it is held by the robot. The robot which holds the green body on the outer surface of its bottom enables the rotary and other motions of the green body in a complicated pattern as required by the work for its finishing, including the removal of any burr formed on the green body along the mating plane of the mold and the boring of a hole in the green body.

The method which employs a pallet as hereinbefore described has always been faced with difficulty in finishing that portion of the green body which rests on the pallet. This problem can be overcome by the method of this invention, since the robot holds the green body on the outer surface of its bottom which is a portion not calling for any finishing in particular, while the green body as a whole is in a raised or suspended position during its finishing.

Thus, this invention enables the mechanized and automated demolding and finishing of a green body a of sanitary ware, such as a washbasin, and thereby a greatly improved efficiency in the manufacture of any such product.

BRIEF DESCRIPTION OF THE DRAWINGS

FIGS. 8A to 8C are a set of views showing a known process for slip casting green bodies for washbasins.

DESCRIPTION OF THE PREFERRED EMBODIMENT

Figure 4:
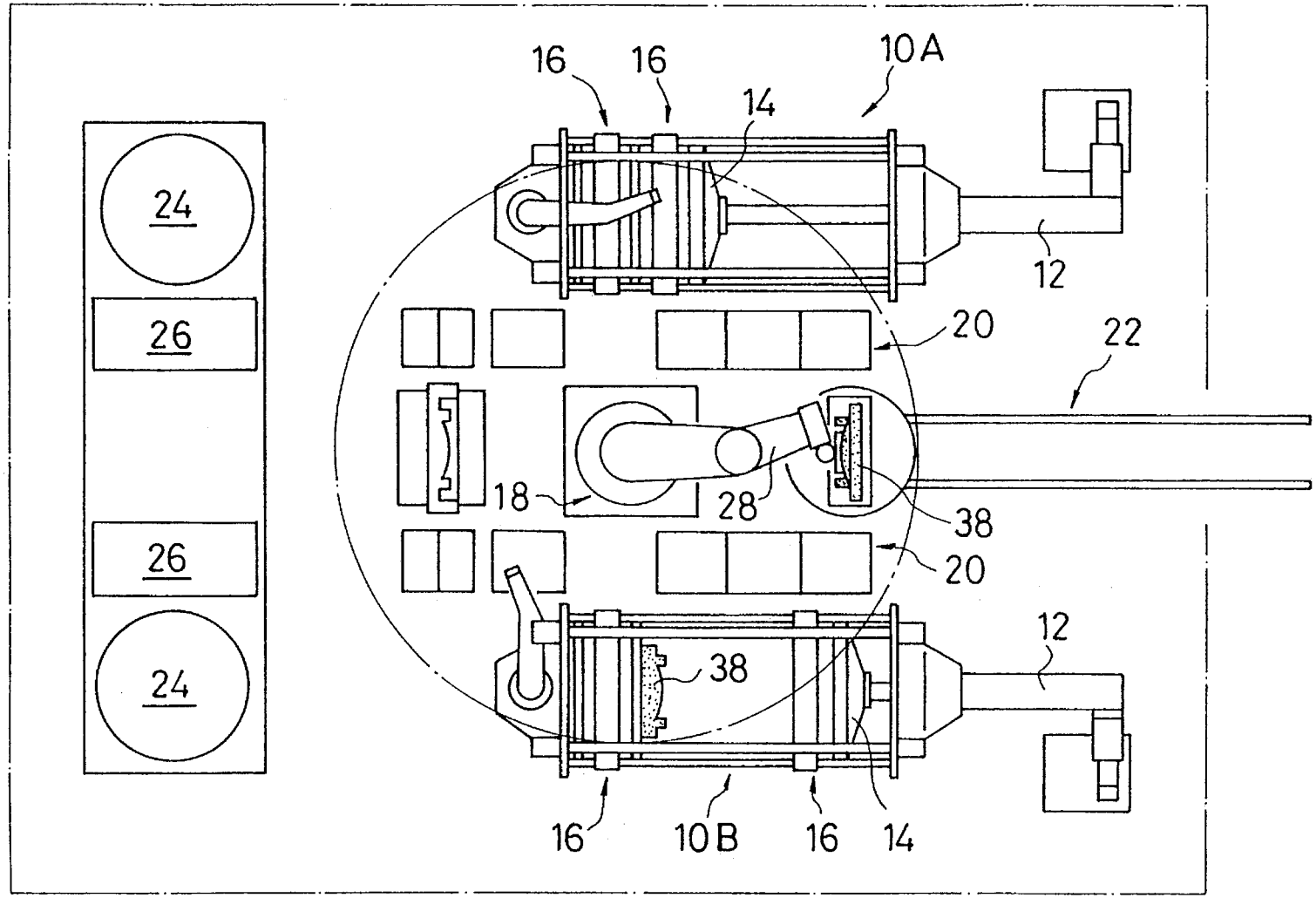
FIG. 4 is a schematic top plan view of an apparatus which can be employed for carrying out the method of this invention.

Description will now be made in detail of a method embodying this invention with reference to the drawings. FIG. 4 shows a schematic top plane view of an apparatus for molding, demolding and finishing green bodies for washbasins as a typical example for a vessel-shaped sanitary ware.

Figure 5:
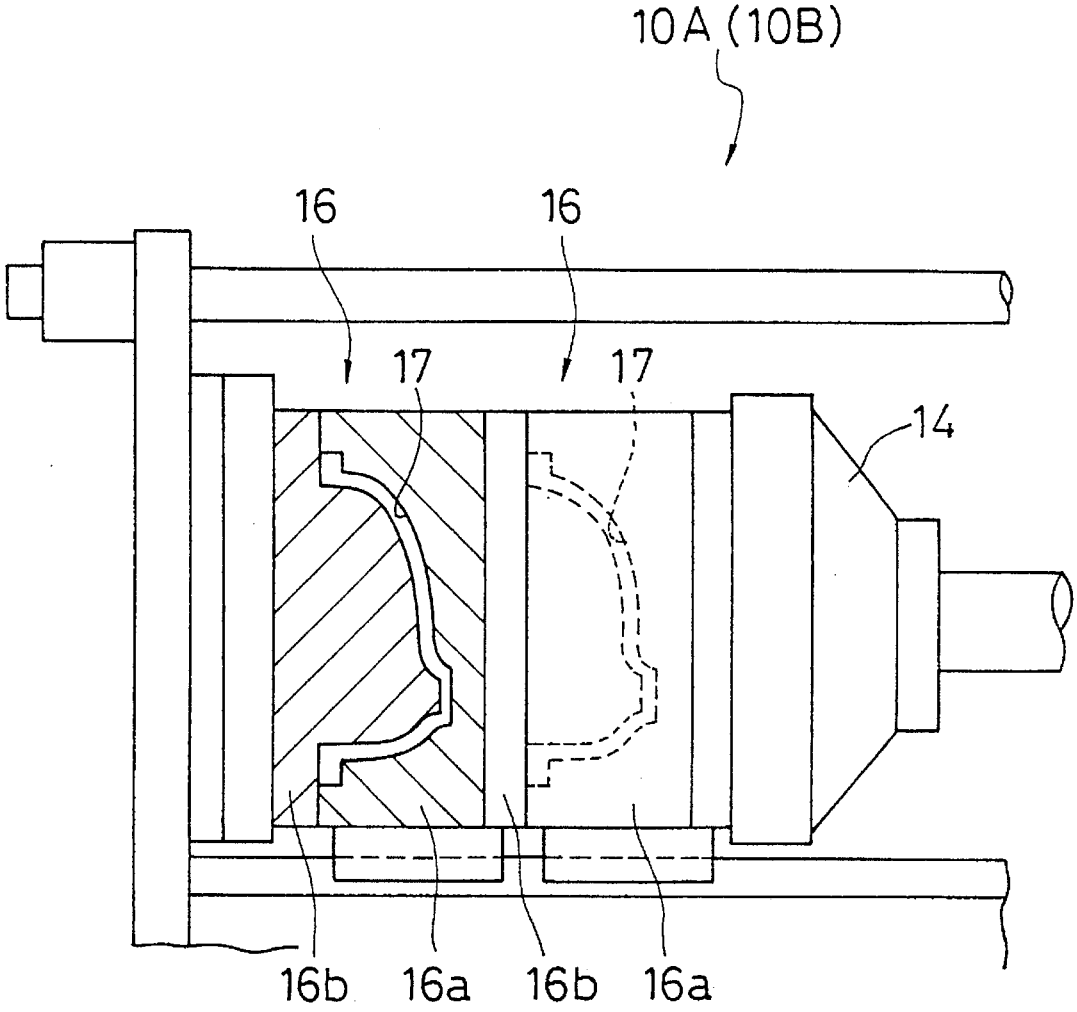
FIG. 5 is an enlarged side elevational view of one of the molding machines including the apparatus and mold of FIG. 4.

The apparatus includes a pair of slip casting machines 10A and 10B in stalled in parallel to each other, and each having a mold clamping cylinder 12 and a mold retaining plate 14 for applying pressure to a plurality of (or more specifically, two) molds 16. Each mold 16 has two split sections 16*a* and 16*b* defining therebetween a mold cavity 17 corresponding in shape to a washbasin, as shown in FIG. 5. The split section 16*a* of one of the molds 16 and the adjacent split section 16*b* of the other mold 16 are formed as a single unit.

The apparatus also includes a robot 18 installed between the casting machines 10A and 10B in an equally spaced relation therefrom. A finishing station 20 is provided between each casting machine 10A or 10B and the robot 18 for finishing each green body 38 (shown in FIG. 2) as by deburring it and boring a hole in it.

The apparatus further includes a conveyor 22 for delivering each green body 38 to another station, a pair of slip tanks 24 and a pair of heaters 26.

Figure 6:
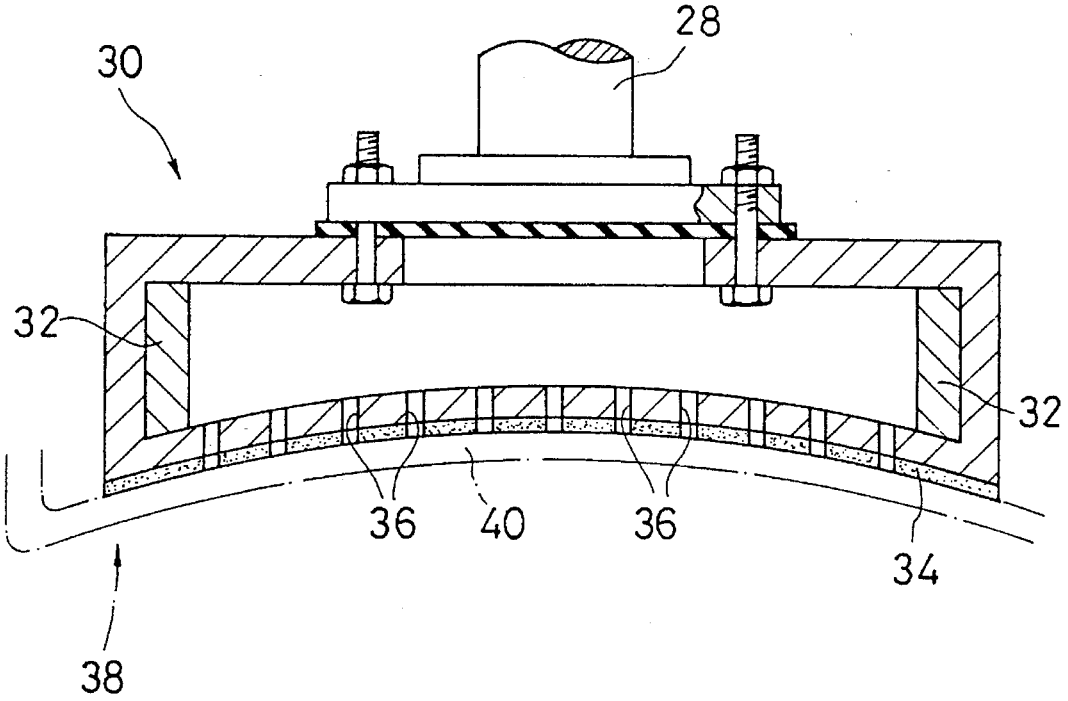
FIG. 6 is an enlarged sectional view of the suction pad shown in FIG. 2.
Figure 7A:
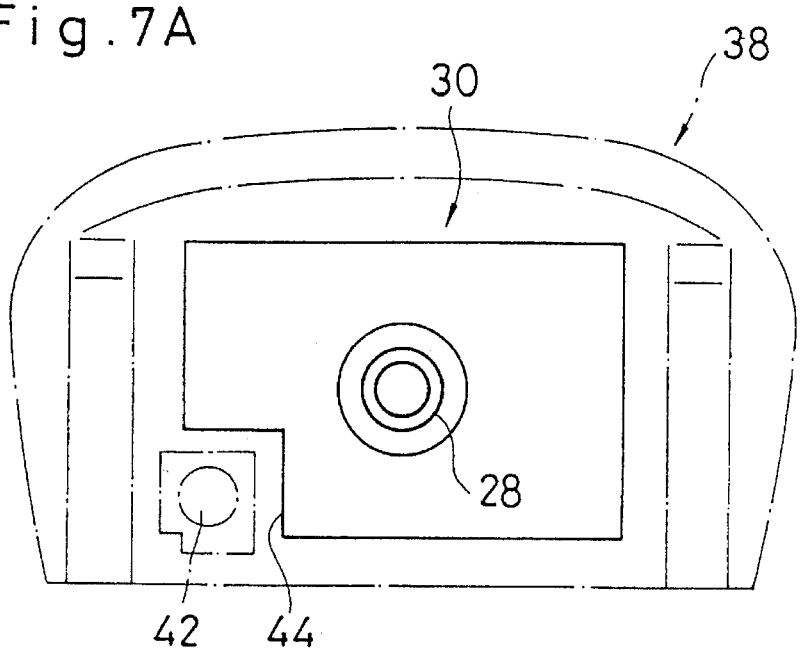
FIGS. 7A to C are a set of views showing the back, side and front, respectively, of the suction pad.
Figure 7B:
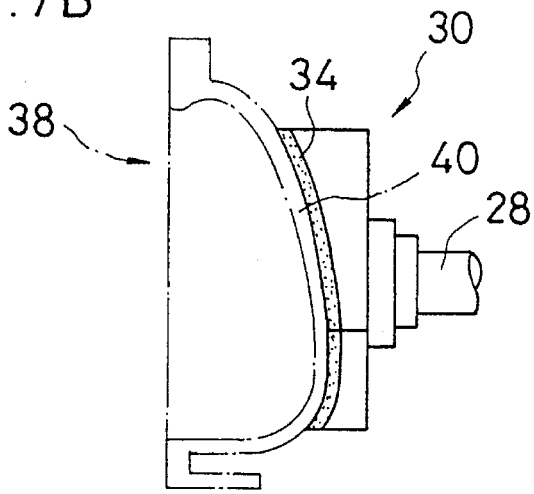
Figure 7C:
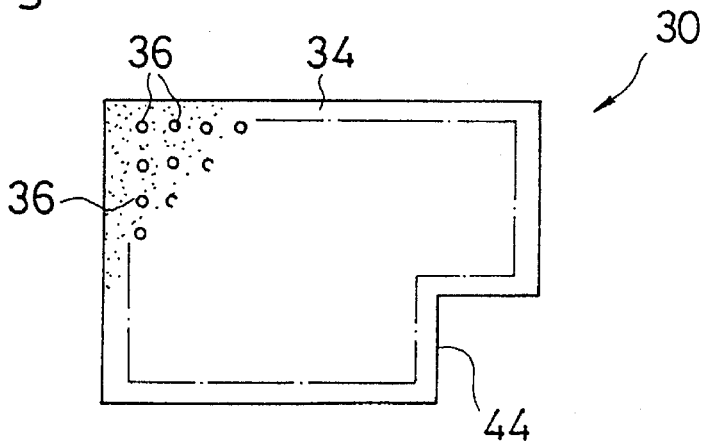

The robot 18 has an arm 28 carrying a suction pad 30 at its free end, as shown in FIGS. 6 and 7B, etc. The suction pad 30 is a hollow box-like body formed from an epoxy resin, and containing a wooden reinforcing member 32. The suction pad 3 has a front or sucking face which is complementary in shape to the outer surface of the bottom 40 of each green body 38, and to which a sheet of an elastic foam 34 is bonded to enable the pad to adhere closely to the green body. The suction pad 30 is provided through its front face with a multiplicity of suction holes 36 through which its outside and its hollow interior are connected. The suction pad 30 has at one corner thereof a recess 44 which enables it to fit on a green body 38 without being obstructed by a drain port 42 projecting from its bottom.

Reference is now made to FIGS. 1A to 1D and 3A to 3C. The apparatus as hereinabove described is employed for molding, demolding and finishing green bodies 38 for washbasins. The two slip casting machines 10A and 10B are alternately used for molding green bodies 38. While one of the machines, e.g. 10A, is used for molding green bodies 38, the green bodies 38 molded in the other machine 10B are demolded and finished, whereby a multiplicity of green bodies 38 are continuously molded and finished.

Figure 1A:
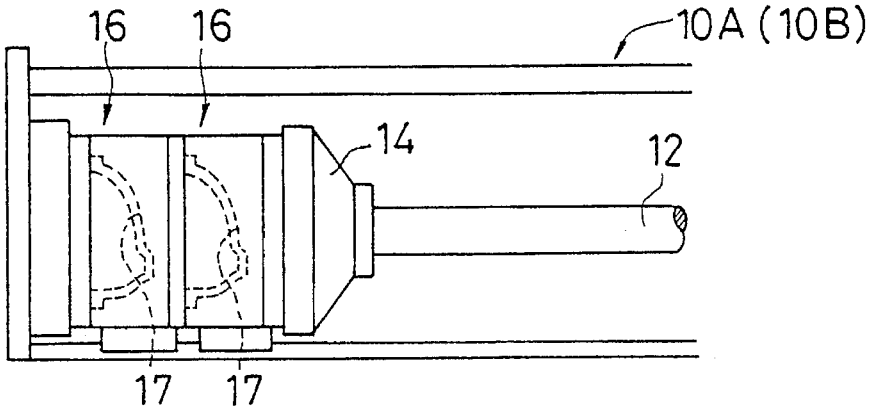
FIGS. 1A to 1D are a series of views illustrating the demolding step of a method embodying this invention.
Figure 1B:
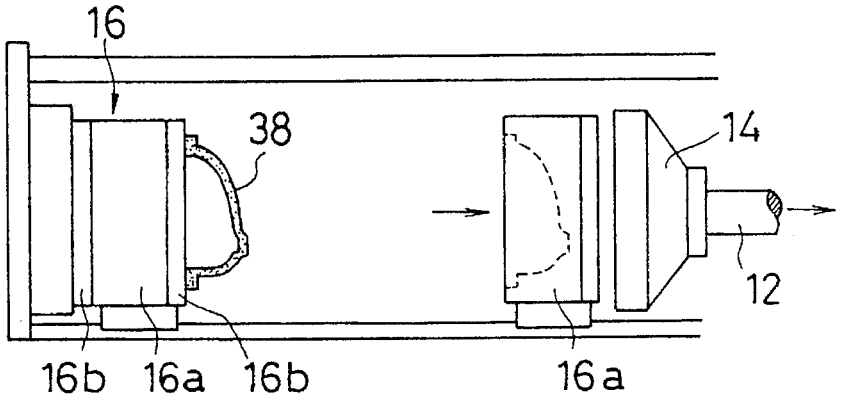
Figure 1C:
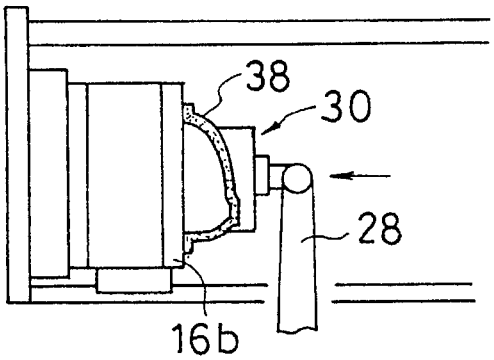
Figure 1D:
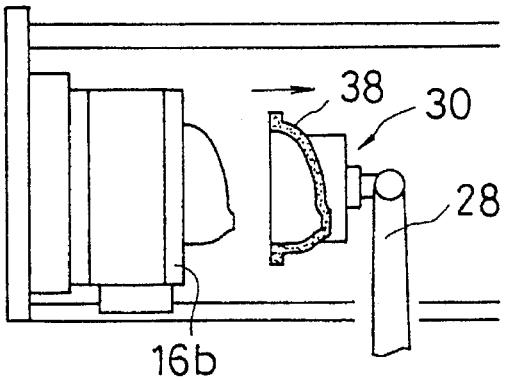
Figure 2:
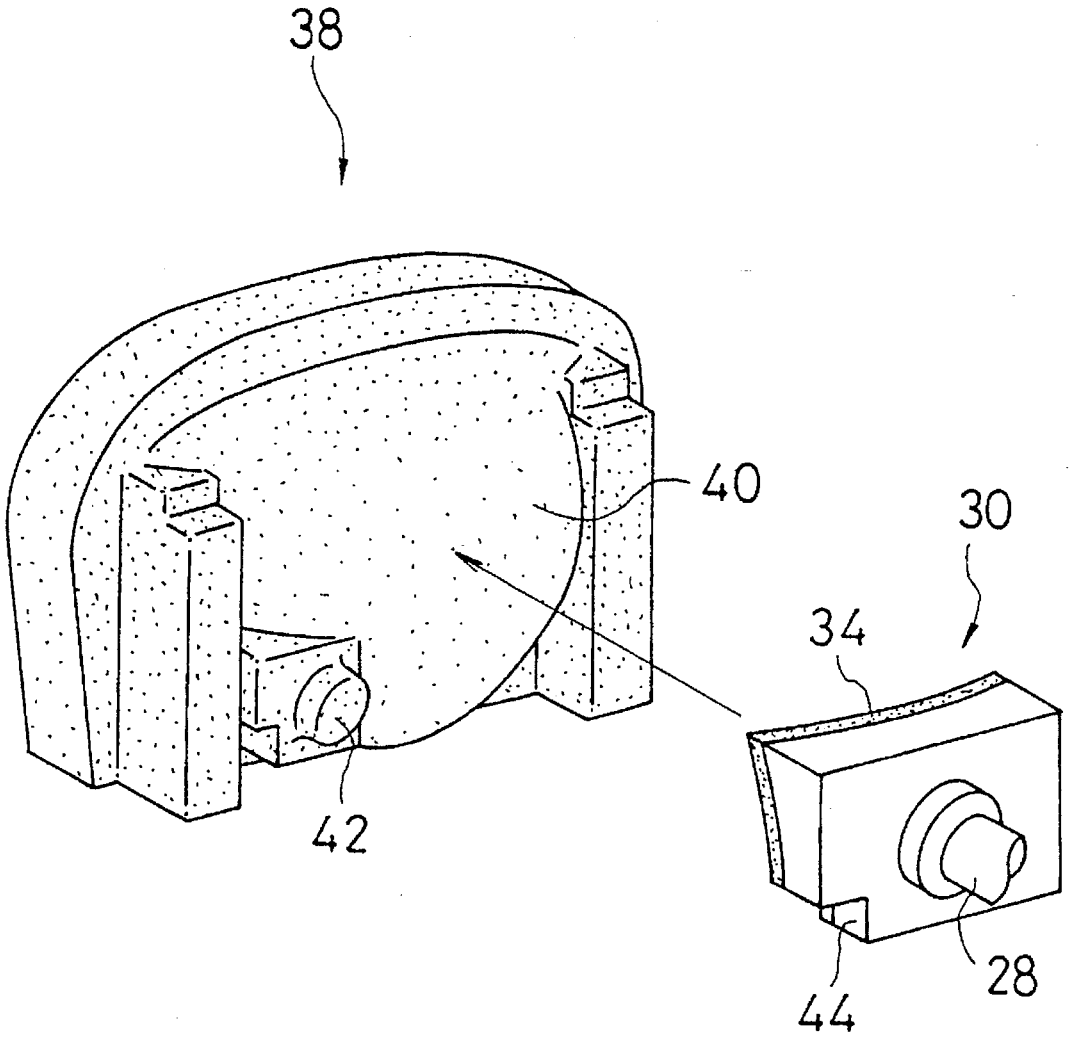
FIG. 2 is a perspective view of a green body and a suction pad employed in the method of the invention.

More specifically, the mold clamping cylinder 12 is retracted to retract the mold retaining plate 14 to thereby open one of the two molds 16 upon completion of one cycle of molding operation in the casting machine. 10A (or 10B), as shown in FIGS. 1A and 1B. The arm 28 of the robot 18 is moved to bring the suction pad 30 into contact with the outer surface of the bottom of a green body 38 left on the split section 16D of the mold 16, as shown in FIGS. 2 and 1C. The suction pad 30 is operated to hold the green body 38 by suction. Then, the robot arm 28 is moved to demold, or separate the green body 38 from the split mold section 16*b*, as shown in FIG. 1D, and convey it to the finishing station 20 where the necessary work is done for finishing the green body 38, including boring and deburring.

Figure 3A:
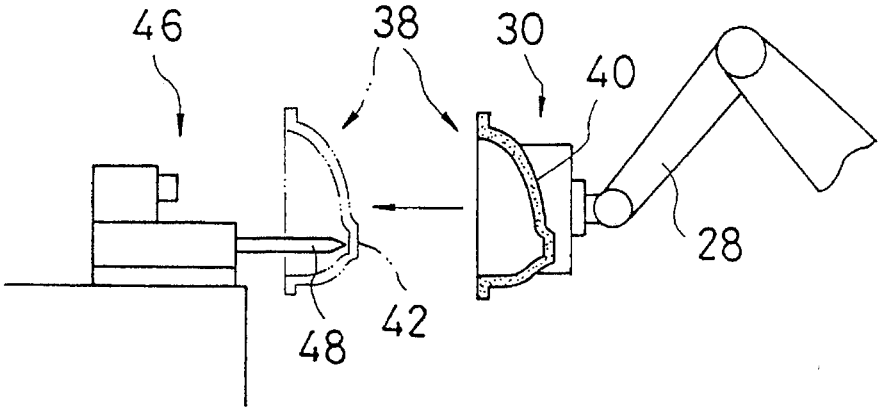
FIGS. 3A to 3C are a set of views illustrating the finishing step of the method embodying this invention.

FIG. 3A shows by way of example a method of boring a hole through the drain port 42 of the green body 38. The green body 38 kept in a suspended position by the robot arm 28 is moved toward a boring device 46 and a boring tool 48 is driven to make a hole through the drain port 42.

Figure 3B:
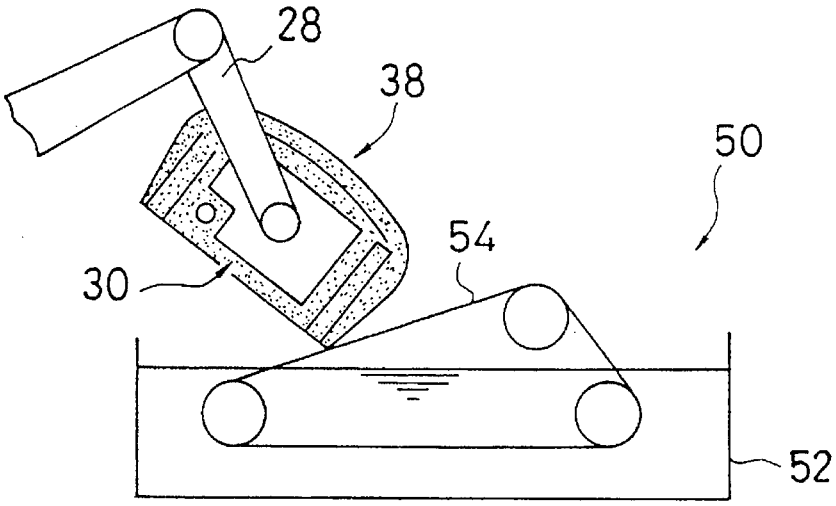

FIG. 3B shows by way of example a method of removing any burr formed on the green body 38 along the mating plane of the mold 16 (or along the top edge of the washbasin). This method employs a deburring device 50 including an endless deburring belt 54 having a portion dipped in water 52. The green body 38 carried on the robot arm 28 is gradually rotated and brought into contact with the belt 54 from one portion to be deburred to another, while the belt 54 is also rotated, whereby any and all burr is eventually removed from the green body 38.

According to this invention, the green body 38 to be finished is held in a raised or suspended position by the robot arm 28, and rotated or otherwise moved in accordance with a predetermined pattern for finishing by a stationary device, while it has hitherto been usual to hold a green body 38 stationary and advance or otherwise move a finishing tool. This invention, thus, makes it possible to automate the finishing work which calls for the complicated relative motions of the finishing device and the green body 38.

Figure 3C:
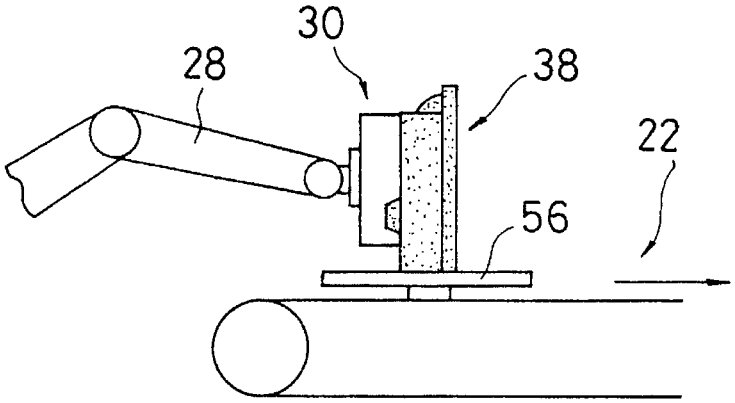

After the necessary finishing work has been done, the green body 38 is transferred from the robot arm 28 to a pallet 56, and delivered by the conveyor 22 to another station, as shown in FIG. 3C.

While each casting machine 10A or 10B has been described as including two molds 16, it is equally possible to provide each casting machine with only one, or more than two molds. While the green body 38 has been described as being delivered to another station by the conveyor 22, it is equally possible to employ a bogie, or like vehicle for that purpose. It is to be understood that the invention has been described and shown with reference to a preferred embodiment thereof, and that variations or modifications may easily be made by anybody of ordinary skill in the art without departing from the scope of this invention.

What is claimed is:

1. A method of demolding and finishing a green body of a sanitary ware formed by slip casting, comprising:

preparing a green body of a sanitary ware in a casting machine, said green body being disposed between two split sections of a mold, opening one split section of the mold to expose a rear portion of the green body with a hole forming portion, holding the rear portion of the green body except the hole forming portion by a suction pad of a robot arm of a robot while sucking air through the suction pad, bringing the green body held by the robot arm to a finishing station including a boring device and a deburring device, said robot arm being operated so that the green body is moved relative to the boring device to bore a hole at the hole forming portion and also moved relative to the deburring device to remove a burr on the green body, and detaching the green body from the robot arm after finishing for further processing of the green body.

2. A method according to claim 1, wherein said suction pad includes a hollow portion, a front portion for covering the hollow portion and having a configuration substantially corresponding to the rear portion of the green body, an elastic foam attached to the front portion for contacting the rear portion of the green body, and a plurality of suction holes formed in the front portion and the elastic foam, air being sucked through the hollow portion and the suction holes so that the rear portion of the green body is fixed to the robot arm by vacuum force.

3. A method according to claim 2, wherein two casting machines are arranged to sandwich the robot therebetween and are alternately employed for casting so that while one of said casting machines is employed for the casting, the green body made in the other casting machine is demolded and finished by the robot arm.

4. A method according to claim 3, wherein said deburring device includes an endless belt having a portion partly dipped in water, said green body supported by the robot arm being contacted with a part of the endless belt not dipped in water to remove the burr on the green body.

5. A method of demolding and finishing green bodies of sanitary wares formed by slip casting, comprising:

disposing two casting machines and a robot such that the robot is sandwiched between the two casting machines, preparing a plurality of green bodies of sanitary wares in one casting machine, each green body being disposed between two split sections of a mold in the casting machine, opening one split section of the mold in the one casting machine when casting is completed to thereby expose a rear portion of one of the green bodies with hole forming portion while the other casting machine is under casting, holding the rear portion of the one green body except the hole forming portion by a suction pad of a robot arm of the robot while sucking air through the suction pad, bringing the one green body held by the robot arm to a finishing station including a boring device and a deburring device, said robot arm being operated so that the one green body is moved relative to the boring device to bore a hole at the hole forming portion and also moved relative to the deburring device to remove a burr on the one green body, detaching the one green body from the robot arm after finishing for further processing of the one green body, holding another green body from said one casting machine by the robot arm, bringing the another green body to the finishing station, and detaching the another green body for further processing, and opening one split section of a mold in the other casting machine for processing and casting new green bodies in said one casting machine where the green bodies are removed.

* * * * *